United States Patent [19]

Gess

[11] Patent Number: 4,466,228

[45] Date of Patent: Aug. 21, 1984

[54] METHOD AND APPARATUS FOR PRODUCING PACKAGES FROM COHESIVE-COATED MEDIA

[75] Inventor: Larry C. Gess, Temperance, Mich.

[73] Assignee: L. C. Gess, Inc., Toledo, Ohio

[21] Appl. No.: 320,662

[22] Filed: Nov. 12, 1981

[51] Int. Cl.[3] ..... B65B 9/02

[52] U.S. Cl. ..... 53/553; 53/329; 53/371; 156/515; 156/553

[58] Field of Search ..... 53/450, 553, 329, 555, 53/550, 511, 433, 371; 156/515, 553

[56] References Cited

U.S. PATENT DOCUMENTS

| | | | |
|---|---|---|---|
| 2,443,327 | 6/1948 | Salfisberg | 53/553 X |
| 2,486,759 | 11/1949 | Pfeiffer | 53/553 X |
| 2,549,122 | 4/1951 | Osterhof | 53/553 X |
| 2,737,764 | 3/1956 | Lewis | 53/553 X |
| 3,229,442 | 1/1966 | Gram | 53/550 X |
| 3,254,471 | 6/1966 | Morham et al. | 53/550 X |
| 3,552,088 | 1/1971 | Niwa | 53/450 X |
| 4,106,265 | 8/1978 | Aterianus | 53/550 |
| 4,164,833 | 8/1979 | Todd | 53/329 X |

*Primary Examiner*—Horace M. Culver
*Attorney, Agent, or Firm*—Allen D. Gutchess, Jr.

[57] ABSTRACT

A method and apparatus are provided for producing packages and particularly substantially wrinkle-free packages from strips of cohesive-coated media. A first strip having a coating of cohesive material facing upwardly is advanced along a supporting surface. After an object to be packaged is deposited thereon, a second strip having a coating of cohesive material facing downwardly is moved over the first strip and the object. The strips are then sealed along an elongate, transverse area in front of the newly-deposited object and behind a previously-deposited one. Subsequently, longitudinal edge portions of both strips are sealed along both sides of the object. As the strip is further advanced, the transverse area is severed along an intermediate line to separate a leading package containing the previously-deposited object from a leading portion of the strips containing the newly-deposited object.

3 Claims, 7 Drawing Figures

METHOD AND APPARATUS FOR PRODUCING PACKAGES FROM COHESIVE-COATED MEDIA

This invention relates to a method and apparatus for producing substantially wrinkle-free packages from strips of material coated with cohesive media.

Packages have heretofore been made from material with coatings of cohesive material thereon. Such material adheres together when pressed together but does not adhere to the object which is packaged or to other material. Such packages, however, commonly had wrinkles, particularly at the leading and the trailing edges of the package, in front of and behind the object which is packaged. These wrinkles have tended to detract from the overall package and, under government specifications, such packages are rated as class 2 packages. Class 1 packages are wrinkle-free and packages heretofore made from cohesive-coated material have not met the class 1 specification.

The present invention provides a method and apparatus for producing substantially wrinkle-free packages from strips of cohesive-coated material which do meet the class 1 government specification. A first strip of the material with the cohesive coating facing upwardly is moved longitudinally along a supporting surface and the object to be packaged is placed on. A second strip of the material with the cohesive coating facing downwardly is then moved over the object and the lower strip with longitudinal edges of both strips being substantially parallel. The strips are then pressed together along elongate transverse areas in front of and behind the object. Subsequently, the strips are pressed together along parallel, elongate longitudinal areas on both sides of the object. Subsequently, the transverse area of the strips behind the object is severed along an intermediate line to separate a leading portion of the strips containing the object from a trailing portion. The leading portion now constitutes the package which is sealed at its leading edge by approximately half of the transverse area and is similarly sealed at the trailing edge, with both side edges sealed by the parallel, longitudinal areas. By sealing the strips along the transverse areas prior to sealing them along the longitudinal, parallel areas, the substantially wrinkle-free package is produced.

It is, therefore, a principal object of the invention to provide a method and apparatus for producing substantially wrinkle-free packages from strips of material having cohesive coatings thereon.

Many other objects and advantages of the invention will be apparent from the following detailed description of a preferred embodiment thereof, reference being made to the accompanying drawings, in which.

Figure 1:
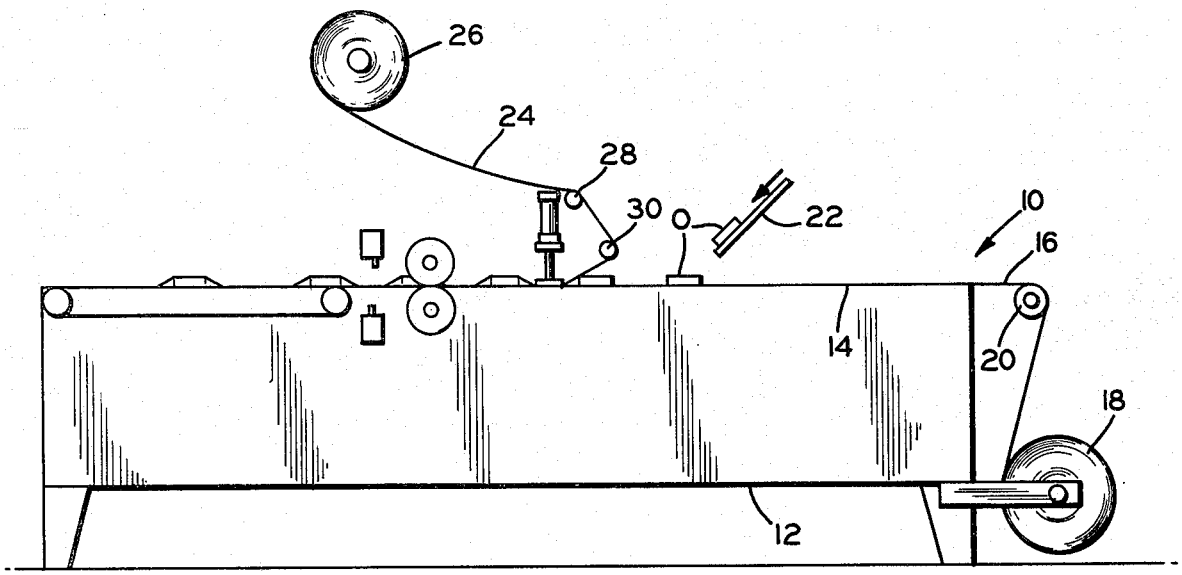
FIG. 1 is a schematic, side view in elevation of an overall packaging machine in accordance with the invention.

Referring to the drawings and particularly to FIG. 1, a packaging apparatus or machine according to the invention is indicated at 10 and includes a frame 12 having an upper supporting plate or surface 14. A first, lower strip 16 of material with a cohesive coating facing upwardly is moved from a supply roll 18 over an idler roller 20 and along the supporting plate 14. An object O to be packaged is deposited on a central portion of the strip 16 from suitable object supplying means such as a chute 22.

A second, upper strip 24 of material having a coating of cohesive material is then moved from a supply roll 26 around guide rolls 28 and 30 and over the lower strip 16 and the object O with the longitudinal edges of both strips being substantially parallel and substantially in alignment. Both of these strips 16 and 24 then pass through a transverse pressing assembly indicated at 32 where the strips are pressed together along an elongate transverse area in front of the newly-deposited object O and behind a previously-deposited object.

Subsequently, the strips 16 and 24 with the objects O are fed through a longitudinally-feeding and pressing assembly 34 where the strips are pressed together along parallel, elongate, longitudinal areas on both sides of the objects. Finally, the strips 16 and 24 and the objects O with the transverse and longitudinal pressed and sealed areas pass through a shearing assembly 36 where the leading portions of the strips 16 and 24 are severed from trailing portions along an intermediate line preferably centrally located with respect to the transverse sealed areas to form a completed package 38 which can be discharged on a suitable discharge conveyor 40.

Figure 3:
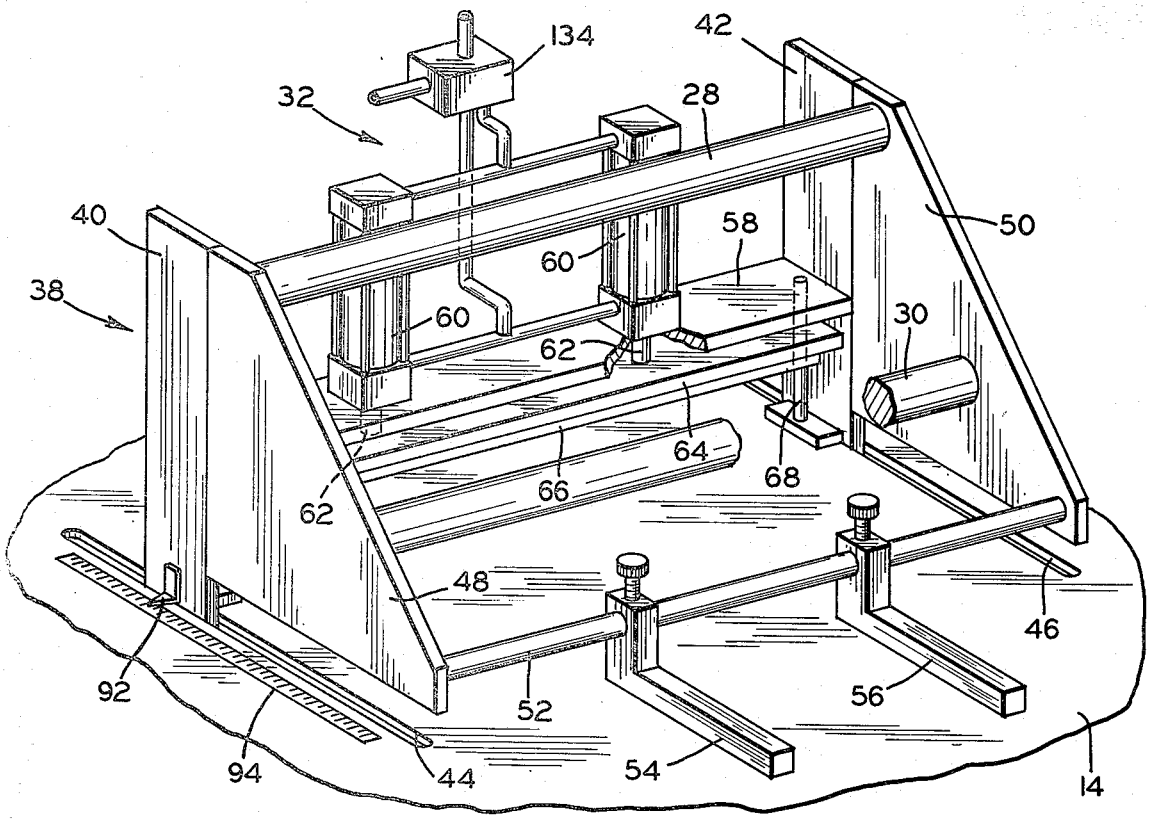
FIG. 3 is a further enlarged fragmentary view in perspective, with parts broken away and with parts in section, of a transverse sealing assembly of the portion of the machine shown in FIG. 2.
Figure 4:
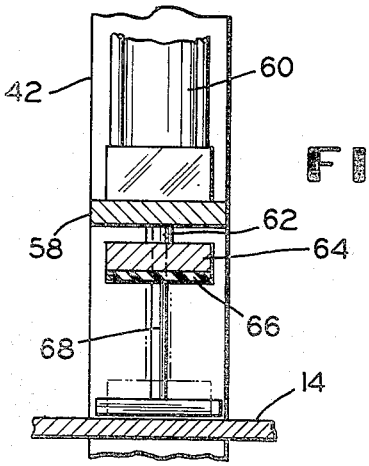
FIG. 4 is a view in transverse cross section of a portion of the assembly shown in FIG. 3.

The transverse pressing assembly 32, the longitudinal pressing assembly 34, and the shearing assembly 36 will now be discussed in more detail. Referring to FIG. 3, the transverse pressing assembly 32 includes a carriage 38 having upright supporting plates or posts 40 and 42 extending through slots 44 and 46 in the supporting plate 14. Side plates 48 and 50 extend from the supporting posts 40 and 42 and carry the guide rollers 28 and 30. A supporting rod 52 extends between extremities of the side plates 48 and 50 and carries guide brackets 54 and 56 to aid in guiding the strip 16 along the path. The brackets are adjustable along the rod to accommodate strips of varying widths. A horizontal supporting plate 58 (FIGS. 3 and 4) extends between intermediate portions of the upright posts 40 and 42 with fluid-operated rams 60 mounted thereon and with piston rods 62 extending therethrough. These are connected to a backup plate 64 having a resilient pressure pad 66 affixed to the lower surface thereof. Side guide rods 68 extend through end portions of the backup plate 64 to guide the movement of the plate and the pressure pad 66. The pad and the plate are moved by the rams 60 between an upper, retracted position near the horizontal supporting plate 58 and a lower pressing position where the lower strip 16 and the upper strip 24 are pressed together between the pad 66 and the supporting plate 14. This results in the transverse sealed area between the objects, with this area being in the order of two to three inches in width, depending upon the size of the packages.

Figure 5:
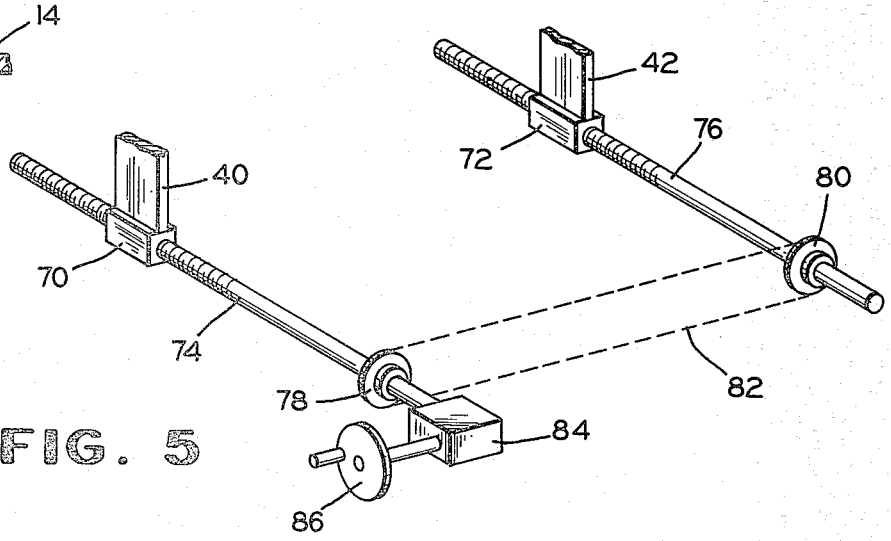
FIG. 5 is a fragmentary view in perspective of mechanism for longitudinally moving the transverse sealing assembly of FIG. 3.

Referring to FIG. 5, the lower ends of the upright posts 40 and 42 terminate in threaded blocks 70 and 72 which are threadedly engaged on threaded rods 74 and 76. The rods are turned in unison, being connected by sprockets 78 and 80 and a chain 82, and are turned by a right-angle drive 84 and a crank 86. When the rods are turned, being rotatably supported in depending brackets 88 and 90 (FIG. 2), the pressing assembly 32 is moved longitudinally relative to the machine 10 to vary the distance between the pressure pad 66 and the shearing assembly 36 to enable the package length to be varied. The package length can be determined by a pointer 92 (FIG. 3) and a measuring tape 94. In some instances, the distance between the pad and the shearing assembly will be more than one package length, being shown here as two package lengths.

Figure 2:
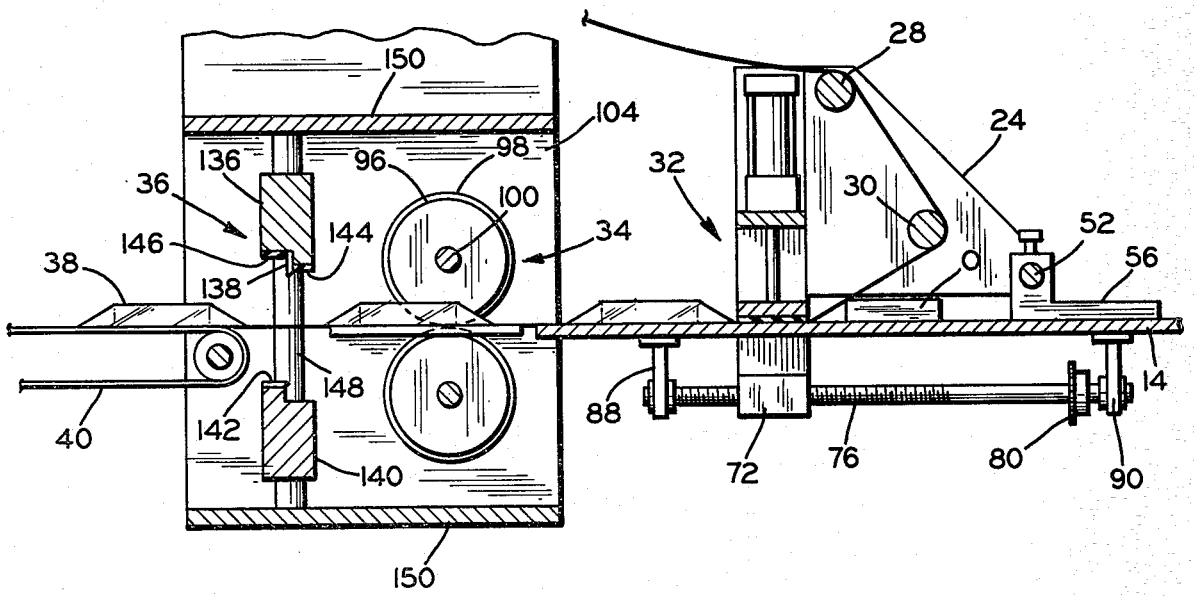
FIG. 2 is an enlarged view in longitudinal cross section of a portion of the machine of FIG. 1.
Figure 6:
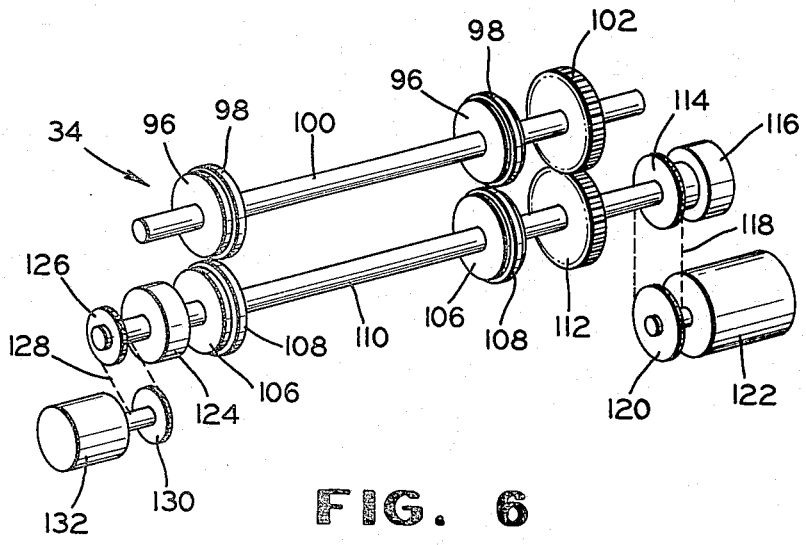
FIG. 6 is a schematic view in perspective of a longitudinal sealing assembly of the portion of the machine shown in FIG. 2.

The longitudinal pressing assembly 34 is shown more fully in FIG. 6. It includes two upper pressure rolls 96 having resilient rims 98 and mounted on an upper shaft 100 to which a spur gear 102 is affixed. The shaft is rotatably supported by suitable side plates 104 (FIG. 2). The assembly 34 also includes lower pressure rolls 106 having resilient rims 108 and mounted on a lower shaft 110 to which a spur gear 112 is affixed. The shaft 110 is also rotatably supported by the side plates 104. The shaft 110 extends beyond the side plates, having a driven sprocket 114 connected through an electromagnetic clutch 116 to the shaft and driven through a chain 118 and a drive sprocket 120 by a motor 122. The opposite end of the shaft 110 has an electromagnetic brake 124 to rapidly stop the shaft and the pressure rolls, when energized. When the pressure rolls are driven, they longitudinally seal on the strips 16 and 24 on both sides of the object O and also advance the strips 16 and 24 along the supporting plate 14 from the supply rolls 18 and 26.

A drive sprocket 126 is also mounted on the shaft 110 and, through a chain 128, drives a sprocket 130 of a commercially-available counter 132. This can be set to determine the package length. When the strips are advanced a distance equal to the package length, the counter 132 deenergizes the electromagnetic clutch 116 to disconnect the sprocket 114 from the shaft 110. At the same time, the counter activates the electromagnetic brake 124 to quickly stop the shaft 110. The counter 132 also activates a solenoid-operated valve 134 (FIG. 3) to supply fluid to the fluid-operated rams 60 in a manner to cause the pressure pad 66 to move down and squeeze the strips 16 and 24 against the plate 14 to form the sealed, transverse area across the strips between two of the objects O. The counter also causes the shear assembly 36 to be deactivated, as will be discussed subsequently.

Figure 7:
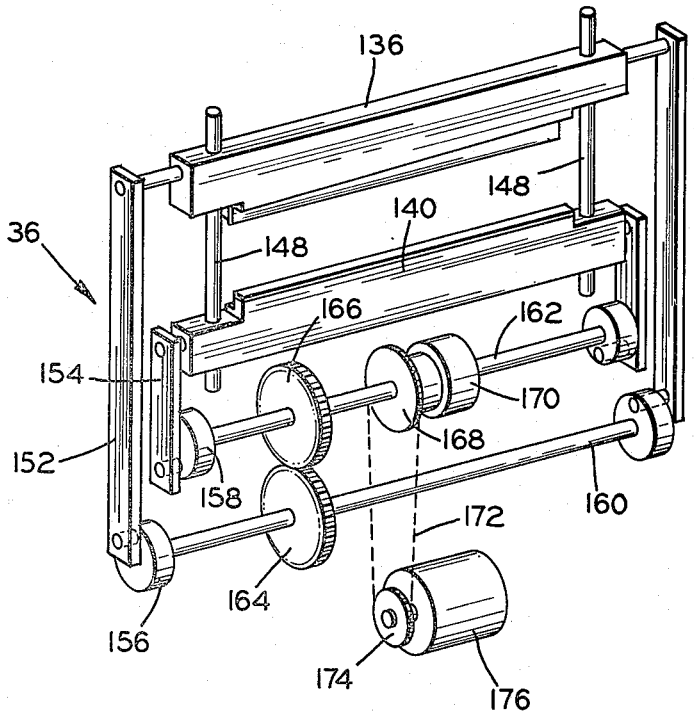
FIG. 7 is a schematic view in perspective of a severing assembly of the portion of the machine shown in FIG. 2.

The shearing assembly 36 is shown in FIGS. 2 and 7. It includes an upper block 136 carrying a shear blade 138 and a lower block 140 carrying a shear blade 142. When the blocks 136 and 140 move together, the shear blades 138 and 142 sever the strips 16 and 24 at an intermediate, preferably middle, line along the transverse sealed area of the strips between the objects. This forms the leading, finished package 38 which is discharged by the conveyor 40. The leading edge of that package is sealed by half of a previously sealed and severed transverse area and the trailing edge of the package is sealed by half of the newly-severed and transverse sealed area, with the sides of the package being sealed along the longitudinal areas.

With the longitudinal sealed areas formed after the transverse sealed areas, the finished package 38 is substantially wrinkle-free. The upper block 136 also has pressure strips 144 and 146 on the sides of the shear blade 138. However, these perform no function except that they can traversely seal the strips if the pressure assembly 32 is not used. In such an instance, the finished package is not wrinkle-free, although this is satisfactory for many applications.

The upper and lower blocks 136 and 140 are slidably mounted on vertical guide rods 148 which are supported between two horizontal plates 150 (FIG. 2) extending between the vertical plates 104. The blocks 136 and 140 are connected to links 152 and 154 which, in turn, are connected to eccentrics 156 and 158. These are mounted on shafts 160 and 162 which are driven together in opposite directions through gears 164 and 166. A driven sprocket 168 is rotatably mounted on the shaft 162 and connected through an electromagnetic clutch 170 to the shaft when the clutch is energized. When the clutch 170 is energized, it drives the shaft 162 through one complete revolution and then is automatically deenergized. This revolution causes the blocks 136 and 140 to move together to a shearing position and then back to the retracted position with the blades 138 and 142 severing the transverse sealed area of the strips between two of the objects O during this motion. The clutch 170 is energized by the counter 132 so that the strips 16 and 24 are transversely sealed along one area when the strips are stopped and at the same time a previously sealed transverse area is severed to form one completed package. The longitudinal sealed area are continuously sequentially formed as long as the strips 16 and 24 are in motion. The transverse sealed areas are always already formed by the time the strips with the transversely-sealed areas reach the pressure rolls. Suitable means can also be provided to supply one of the objects O to the chute 22 and onto the lower strip when the strip is stopped.

Various modifications of the above-described embodiment of the invention will be apparent to those skilled in the art and it is to be understood that such modifications can be made without departing from the scope of the invention if they are within the spirit and the tenor of the accompanying claims.

I claim:

1. Apparatus for making a package containing an object from two strips of material having cohesive coatings thereon, said apparatus comprising means forming a supporting surface for supporting a lower strip of the material with the cohesive coating facing upwardly, means for placing an object on the lower strip, means for positioning an upper strip of the material with the cohesive coating facing downwardly over the object and over the lower strip with the longitudinal edges of both strips being substantially parallel, means for pressing together the strips along a transverse area in front of the object and then in back of the object, supporting posts spaced apart beyond side edges of said strips for supporting said pressing means, means for pressing together the strips along parallel, longitudinal areas on each side of the object after the transverse area of the strips in front of the object is pressed, means for subsequently separating a leading portion of the strips containing the object from a trailing portion by severing the strips along an intermediate portion of the transverse area behind the object, and means for simultaneously moving said posts and said pressing means toward and away from said separating means to change the package length.

2. Apparatus for making packages containing objects from two strips of material having cohesive coatings thereon, said apparatus comprising means forming a supporting surface for supporting the lower strip of the material with the cohesive coating facing upwardly, means for placing objects on the lower strip, means for positioning an upper strip of the material with the cohesive coating facing downwardly over the objects and over the lower strip, pressure pad means for pressing together the strips along transverse areas between the objects, supporting posts spaced beyond side edges of said strips for supporting said pressure pad means, pressure roll means beyond said transverse pressure means for sequentially pressing together the strips along parallel, longitudinal areas on both sides of the objects and for moving the strips longitudinally, shearing means beyond said pressure roll means for severing the strips along intermediate portions of the transverse areas, and means for moving said posts and pressure pad means toward and away from said shearing means to change the package length.

3. Apparatus according to claim 2 characterized by a threaded member engageable with each of said posts, and means for simultaneously turning said threaded members equal amounts.

* * * * *